US006791518B2

(12) United States Patent
Furukoshi

(10) Patent No.: US 6,791,518 B2
(45) Date of Patent: Sep. 14, 2004

(54) CONTROLLER AND CONTROL METHOD FOR LIQUID-CRYSTAL DISPLAY PANEL, AND LIQUID-CRYSTAL DISPLAY DEVICE

(75) Inventor: Yasutake Furukoshi, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 0 days.

(21) Appl. No.: 09/061,543

(22) Filed: Apr. 16, 1998

(65) Prior Publication Data

US 2001/0013849 A1 Aug. 16, 2001

(30) Foreign Application Priority Data

Apr. 18, 1997 (JP) ..... 9-101606

(51) Int. Cl.[7] ..... G09G 3/36

(52) U.S. Cl. ..... 345/87; 345/98; 345/100; 345/213

(58) Field of Search ..... 345/87, 88, 98, 345/100, 211, 213, 212, 99, 3.1–3.3

(56) References Cited

U.S. PATENT DOCUMENTS 5,610,622 A * 3/1997 Takeda et al. ..... 345/213
5,731,798 A * 3/1998 Shin ..... 345/213
5,781,185 A * 7/1998 Shin ..... 345/213
5,859,635 A * 1/1999 Hang et al. ..... 345/213
5,874,949 A * 2/1999 Furukawa ..... 345/213
5,940,061 A * 8/1999 Sato ..... 345/213
5,966,119 A * 10/1999 Hwang ..... 345/213
6,046,737 A * 4/2000 Nakamura ..... 345/213
6,049,318 A * 4/2000 Ota ..... 345/93
6,211,850 B1 * 4/2001 Komatsu ..... 345/87
6,329,975 B1 * 12/2001 Yamaguchi ..... 345/99

FOREIGN PATENT DOCUMENTS

| | | |
|---|---|---|
| JP | 62-6212 | 1/1987 |
| JP | 1-303883 | 12/1989 |
| JP | 93-1363 | 1/1993 |
| JP | 5-119747 | 5/1993 |
| JP | 5-292421 | 11/1993 |
| JP | 95-19824 | 7/1995 |
| JP | 7-203293 | 8/1995 |
| JP | 8-95532 | 4/1996 |
| JP | 8-160922 | 6/1996 |
| JP | 7-327178 | 12/1996 |
| JP | 9-204157 | 8/1997 |

* cited by examiner

*Primary Examiner*—Richard Hjerpe
*Assistant Examiner*—Kimnhung Nguyen
(74) *Attorney, Agent, or Firm*—Greer, Burns & Crain, Ltd.

(57) ABSTRACT

A timing controller for a liquid-crystal display panel includes a data enable signal detection circuit which detects a data enable signal applied to the timing controller, and a timing generating circuit which controls a display timing of image data to be displayed on the liquid-crystal display panel on the basis of the data enable signal detected by the data enable signal detection circuit.

5 Claims, 16 Drawing Sheets

CONTROLLER AND CONTROL METHOD FOR LIQUID-CRYSTAL DISPLAY PANEL, AND LIQUID-CRYSTAL DISPLAY DEVICE

BACKGROUND OF THE INVENTION

1. Field of the Invention

The present invention generally relates to liquid-crystal displays, and more particularly to a controller for controlling drivers which drive a liquid-crystal display panel so that display timings at which image data is displayed on the panel are controlled.

2. Description of the Related Art

FIG. 1 is a block diagram of a conventional liquid-crystal display device of an XGA type (1024×768 dots). The device includes a liquid-crystal display panel 10 of an active matrix type, a data driver 11, a gate driver 12 and a liquid-crystal display timing controller 13. The data driver 11 drives a data bus (signal lines) formed on the liquid-crystal display panel 10. The gate driver 12 drives a gate bus (scanning lines) formed on the liquid-crystal display panel 10.

The timing controller 13 receives, from an image data supply source (not shown), a vertical synchronizing signal VSYNC, a horizontal synchronizing signal HSYNC, a clock CLK, a data enable signal ENAB and image data DATA, and controls, based on the vertical synchronizing signal VSYNC and the horizontal synchronizing signal HSYNC, display timings at which the image data DATA is displayed on the panel 10.

The timing controller 13 supplies the data driver 11 with a data driver clock D-CLK, a data driver start pulse D-SP, a latch pulse LP and image data DATA, and supplies the gate driver 12 with a gate driver clock G-CLK and a gate driver start pulse G-SP.

FIG. 2 is a timing chart showing a drive timing in the horizontal direction of the conventional liquid-crystal display device shown in FIG. 10. Part (A) of FIG. 11 shows the horizontal synchronizing signal HSYNC, part (B) shows the clock CLK, part (C) shows the image data DATA, and part (D) shows the data enable signal ENAB. Further, a symbol Th denotes a horizontal cycle period, Thp denotes a horizontal blanking period, Thd denotes a display valid period, Thb denotes a back porch of the display valid period Thd, and Thf denotes a front porch of the display valid period Thd.

FIG. 3 is a drive timing in the vertical direction of the conventional liquid-crystal display device shown in FIG. 1. Part (A) of FIG. 3 shows the vertical synchronizing signal VSYNC, part (B) shows the horizontal synchronizing signal HSYNC, part (C) shows the image data DATA, and part (D) shows the data enable signal ENAB. Further, a symbol Tv denotes a vertical cycle period, Tvp denotes a vertical blanking period, Tvd denotes a display valid period, Tvb denotes a back porch of the display valid period Tvd, and Tvf is a front porch of the display valid period Tvd.

FIG. 4 shows a relationship between a data display area 15 and a blank area 16 during one vertical cycle period of the conventional liquid-crystal display device shown in FIG. 1. The data display area 15 includes pixels arranged in a matrix formation. The blank area 16 does not have pixels. The horizontal length of the blank area 16 amounts to 1184 clocks, and the vertical length thereof is equal to 806 lines. The horizontal length of the data display area 15 amounts to 1024 clocks, and the vertical length thereof is equal to 768 lines.

However, the above-mentioned prior art has the following disadvantages.

The timing controller 13 has the fixed values of the back porches Thb and Tvb and the fixed values of the front porches Thf and Tvf. The back porches Thb and Tvb and the front porches Thf and Tvf define the display timing (display period) of the liquid-crystal panel 10. In other words, the timings of the display valid periods Thd and Tvd are fixed. The timing controller 13 controls the data driver 11 and the gate driver 12 by using the fixed values of the back porches Thb and Tvb and front porches Thf and Tvf.

As shown in FIG. 4, if the fixed values of the back porches Thb and Tvb exactly indicate the starting pixel of the data display area 15 located in the first line and scanned by the first clock of the 1024 clocks, the image data can correctly be displayed on the data display area 15 during the data valid periods Thd and Tvd in synchronism with the data enable signal ENAB.

The values of the back porches Thb and Tvb and those of the front porches Thf and Tvf depend on the timing specification of an electronic device such as a personal computer to which the liquid-crystal display device is provided. For example, the timing specification of the electronic device is first determined, and the fixed values of the back porches Thb and Tvb and those of the front porches Thf and Tvf are then selected so as to meet the specification. Alternatively, the timing specification of the electronic device is determined so as to conform with the fixed values of the back porches Thb and Tvb and those of the front porches Thf and Tvf.

If the fixed values of the back porches Thb and Tvb and those of the front porches Thf and Tvf do not match the timing specification of the electronic device, the image data cannot be correctly displayed on the data display area 15. For example, the image data is offset on the data display area 15 in the vertical and/or horizontal direction thereof and some image is lost.

Hence, the timing controller 13 cannot be applied to various timing specifications of the electronic devices to which the liquid-crystal display device is provided, but can be applied to the specific timing specification only. In practice, the timing controllers 13 having the different timing specifications are designed so as to meet the respective timing specifications of electronic devices to which the liquid-crystal display devices are provided. Usually, it takes a long time (for example, one month) to design the timing controller 13 and ship samples thereof, and it takes a further long time (for example, two months) to go into quantity production. Hence, the above-mentioned disadvantages of the prior art make it difficult to rapidly develop and manufacture electronic devices having the respective timing specifications.

SUMMARY OF THE INVENTION

It is a general object of the present invention to provide a controller for a liquid-crystal display panel in which the above-mentioned disadvantages are eliminated.

A more specific object of the present invention is to provide a controller for a liquid-crystal display panel which can be applied to various timing specifications of electronic devices to which the liquid-crystal display panel is provided.

The above objects of the present invention are achieved by a timing controller for a liquid-crystal display panel comprising: a data enable signal detection circuit (20) which detects a data enable signal applied to the timing controller; and a timing generating circuit (32) which controls a display timing of image data to be displayed on the liquid-crystal display panel on the basis of the data enable signal detected by the data enable signal detection circuit.

The above timing controller may be configured so that the timing generating circuit comprises a first circuit (FIG. 15C) which generates, from the data enable signal, a first start pulse (D-ST) which starts driving each data line of the liquid-crystal display panel, and a second circuit (FIG. 15F) which generates, from the data enable signal, a second start pulse (G-SP) which starts driving scanning lines of the liquid-crystal display panel.

The above timing controller may be configured so that the timing generating circuit comprises a circuit part (FIG. 15F) which detects a beginning of each frame on the basis of the data enable signal.

The timing controller may further comprise: a synchronizing signal detection circuit (22, 23, 24) which detects vertical and horizontal synchronizing signals; and a pseudo-data-enable signal generating circuit (25) which generates a pseudo-data-enable signal when the synchronization signal detection circuit detects the vertical and horizontal synchronizing signals while the data enable signal detection circuit does not detect the data enable signal, wherein the timing generating circuit controls the display timing of image data on the basis of the pseudo-data-enable signal.

The timing controller may further comprise: a synchronizing signal detection circuit (22, 23, 24) which detects vertical and horizontal synchronizing signals; and a protection circuit (27) which generates a pseudo-data-enable signal when the data enable signal and the vertical and horizontal synchronizing signals are not detected, wherein the timing generating circuit controls the display timing of image data on the basis of the pseudo-data-enable signal.

Another object of the present invention is to provide a method of controlling a display timing for a liquid-crystal display panel, the method comprising the steps of: (a) detecting a data enable signal applied together with image data (step ST2); and (b) controlling the display timing of the image data to be displayed on the liquid-crystal display panel on the basis of the data enable signal detected by the step (a) (step ST3).

A further object of the present invention is to provide a liquid-crystal display device equipped with the above timing controller.

This object of the present invention is achieved by a liquid-crystal display device comprising: a liquid-crystal display panel (10) having signal lines and scanning lines; a data driver (11) which drives the signal lines; a gate driver (12) which drives the scanning lines; and a timing controller (FIG. 5) controlling a display timing of image data to be displayed on the liquid-crystal display panel. The timing controller comprises: a data enable signal detection circuit (20) which detects a data enable signal applied to the timing controller; and a timing generating circuit (32) which controls the display timing on the basis of the data enable signal detected by the data enable signal detection circuit.

The above liquid-crystal display device may be configured so that the timing generating circuit comprises a first circuit (FIG. 15C) which generates, from the data enable signal, a first start pulse (D-ST) which starts driving each of the data lines, and a second circuit (FIG. 15F) which generates, from the data enable signal, a second start pulse (G-SP) which starts driving the scanning lines.

The liquid-crystal display device may be configured so that the timing generating circuit comprises a circuit part (FIG. 15F) which detects a beginning of each frame on the basis of the data enable signal.

The liquid-crystal display device may further comprise: a synchronizing signal detection circuit (22, 23, 24) which detects vertical and horizontal synchronizing signals; and a pseudo-data-enable signal generating circuit (25) which generates a pseudo-data-enable signal when the synchronization signal detection circuit detects the vertical and horizontal synchronizing signals while the data enable signal detection circuit does not detect the data enable signal, wherein the timing generating circuit controls the display timing of image data on the basis of the pseudo-data-enable signal.

The liquid-crystal display device may further comprise: a synchronizing signal detection circuit (22, 23, 24) which detects vertical and horizontal synchronizing signals; and a protection circuit (27) which generates a pseudo-data-enable signal when the data enable signal and the vertical and horizontal synchronizing signals are not detected, wherein the timing generating circuit controls the display timing of image data on the basis of the pseudo-data-enable signal.

The liquid-crystal display device may further comprise: a synchronizing signal detection circuit (22, 23, 24) which detects vertical and horizontal synchronizing signals; a pseudo-data-enable signal generating circuit (25) which generates a first pseudo-data-enable signal when the synchronization signal detection circuit detects the vertical and horizontal synchronizing signals while the data enable signal detection circuit does not detect the data enable signal; and a protection circuit (27) which generates a second pseudo-data-enable signal when the data enable signal and the vertical and horizontal synchronizing signals are not detected, wherein the timing generating circuit controls the display timing of image data on the basis of any of the data enable signal, the first pseudo-data-enable signal and the second pseudo-data-enable signal.

BRIEF DESCRIPTION OF THE DRAWINGS

Other objects, features and advantages of the present invention will become more apparent from the following detained description when read in conjunction with the accompanying drawings in which.

DESCRIPTION OF THE PREFERRED EMBODIMENTS

A description will now be given, with reference to FIG. 5, of a timing controller according to an embodiment of the present invention.

Figure 1:
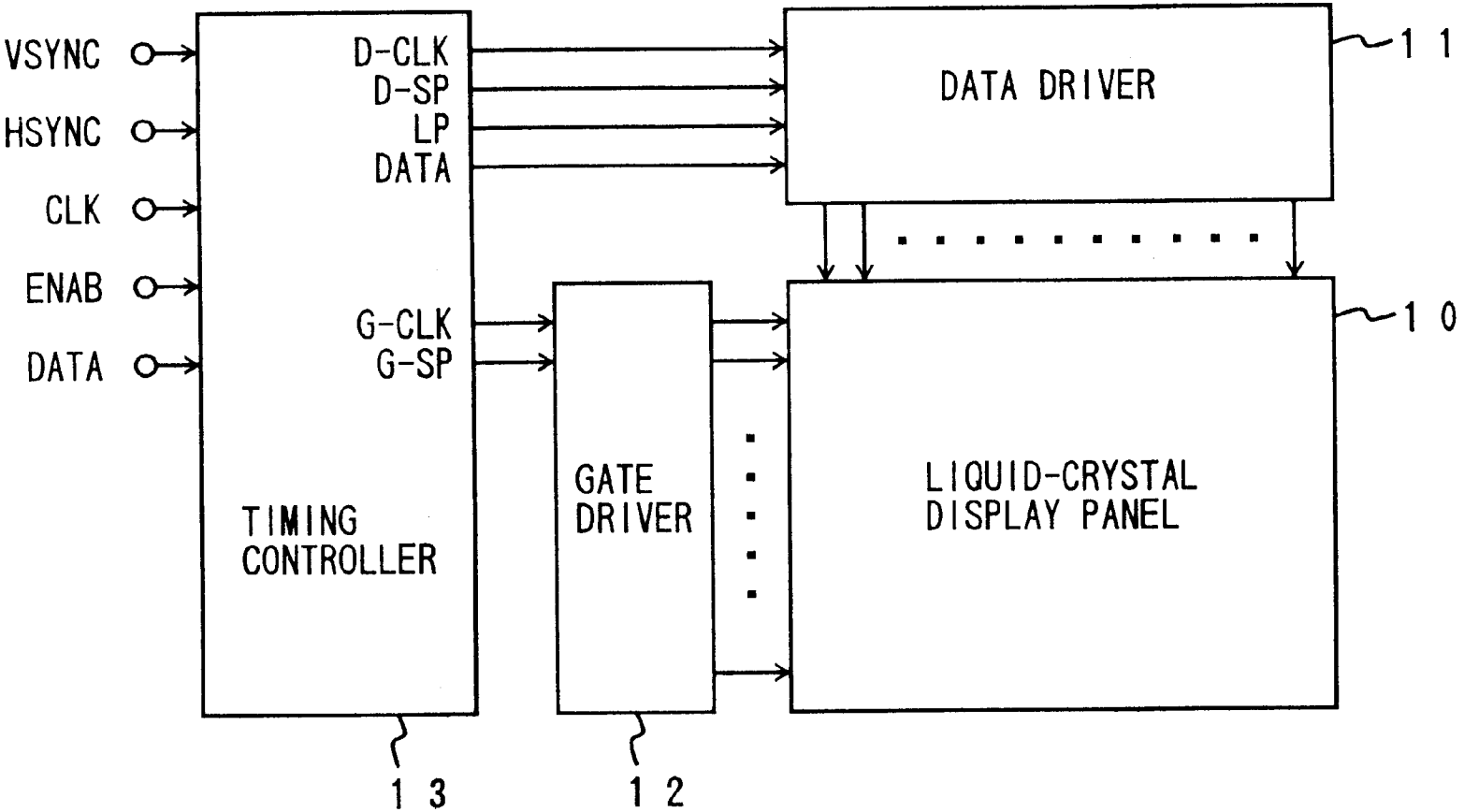
FIG. 1 PRIOR ART
FIG. 1 is a block diagram of a conventional liquid-crystal display device.
Figure 5:
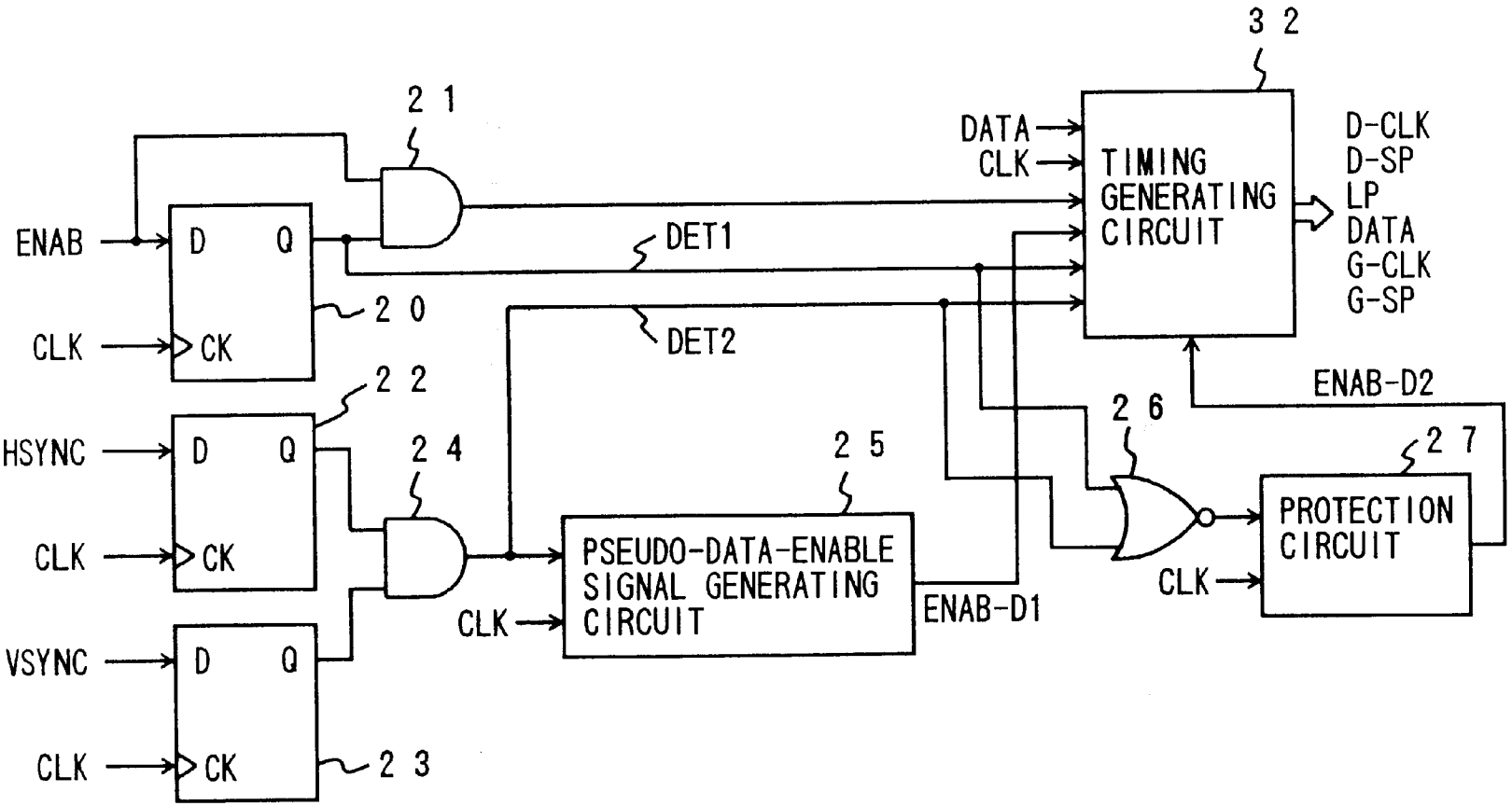
FIG. 5 is a block diagram of a timing controller according to an embodiment of the present invention.

FIG. 5 shows a structure of a timing controller, which can be substituted for the timing controller 13 shown in FIG. 1. That is, the liquid-crystal display device of the present invention includes the timing controller shown in FIG. 5, the data driver 11, the gate driver 12 and the liquid-crystal display panel 10.

The timing controller shown in FIG. 5 has three display timing control modes which are different from the conventional display timing control using the fixed values of the back porches Thb and Tvb and the fixed values of the front porches Thf and Tvb. The first display timing control mode is directly replaced by the conventional display timing control, and the second and third display timing control modes serve as backup or additional modes of the first mode. That is, the second and third display timing control modes are optional modes, which may be omitted.

The timing controller shown in FIG. 5 includes D-type flip-flops 20, 22 and 23, AND circuits 21 and 24, a pseudo-data-enable signal generating circuit 25, a NOR circuit 26, a protection circuit 27 and a timing generating circuit 32. Generally, the first display timing control mode is implemented by the D-type flip-flop 20, the AND circuit 21 and the timing generating circuit 32. The second display timing control mode is implemented by the D-type flip-flops 22 and 23, the AND circuit 24, the pseudo-data-enable signal generating circuit 25, and the timing generating circuit 32. The third display timing control mode is implemented by the NOR circuit 26, the protection circuit 27 and the timing generating circuit 32.

The D-type flip-flop 20 latches the data enable signal ENAB in synchronism with the clock CLK supplied from the image data supply source (not shown) provided outside of the liquid-crystal display device, and thus functions as a data enable signal detector. The data enable signal ENAB is also supplied from the image data supply source. When the data enable signal ENAB is activated, a supply of image data generated by the image data supply source is initiated. The first display timing control mode utilizes the data enable signal ENAB in order to control the display timing, as will be described in detail later.

The AND circuit 21 performs an AND operation on the data enable signal ENAB and an output signal DET1 of the D-type flip-flop 20. The output signal DET1 of the D-type flip-flop 20 is switched to a high potential (H level) when the data enable signal ENAB is supplied (activated) from the image data supply source. Hence, the data enable signal ENAB is output from the AND circuit 21. When the data enable signal is not supplied (disabled or inactivated), the output signal DET1 of the D-type flip-flop 20 is at a low potential (L level), and the output signal of the AND circuit 21 is low.

The D-type flip-flop 22 latches the horizontal synchronizing signal HSYNC in synchronism with the clock CLK, and thus functions as a horizontal synchronizing signal detector. The D-type flip-flop 23 latches the vertical synchronizing signal VSYNC in synchronism with the clock CLK, and thus functions as a vertical synchronizing signal detector.

The AND circuit 24 performs an AND operation on the output signals of the D-type flip-flops 22 and 23. The D-type flip-flops 22 and 23 and the AND circuit 24 form a horizontal/vertical synchronizing signal detection circuit.

The horizontal synchronizing signal HSYNC and the vertical synchronizing signal VSYNC are supplied from the image data supply source. Then, the output signals of the D-type flip-flops 22 and 23 are switched to the high level, and thus the output signal DET2 of the AND circuit 24 is switched to the high level. The output signal DET2 of the AND circuit 24 is applied to the timing generating circuit 32.

If the horizontal synchronizing signal HSYNC and the vertical synchronizing signal VSYNC are not supplied from the image data supply source, the output signals of the D-type flip-flops 22 and 23 are switched to the low level, and thus the output signal of the AND circuit 24 is switched to the low level.

The pseudo-data-enable signal generating circuit 25 receives the clock CLK supplied from the image data supply source and the output signal DET2 of the AND circuit 24, and generates a pseudo-data-enable signal ENAB-D1 at a predetermined timing after the output signal DET2 of the AND circuit 24 is switched to the high level. The pseudo-data-enable signal ENAB-D1 is applied to the timing generating circuit 32.

The NOR circuit 26 performs a NOR operation on the output signal DET1 of the D-type flip-flop 20 and the output signal DET2 of the AND circuit 24.

The output signal of the NOR circuit 26 is switched to the low level, when the output signal DET1 of the D-type flip-flop 20 is switched to the high level, that is, when the data enable signal ENAB is supplied from the image data supply source, or when the output signal DET2 of the AND circuit 24 is switched to the high level, that is, when the horizontal synchronizing signal HSYNC and the vertical synchronizing signal VSYNC are supplied from the image data supply source.

In contrast, the output signal of the NOR circuit 26 is switched to the high level when the output signal DET1 of the D-type flip-flop 20 is at the low level and the output signal DET2 of the AND circuit 24 is at the low level, that is, when the data enable signal ENAB, the horizontal synchronizing signal HSYNC and the vertical synchronizing signal VSYNC are not supplied from the image data supply source at all.

The protection circuit 27 receives the clock CLK supplied from the image data supply source and the output signal of the NOR circuit 26, and generates a pseudo-data-enable signal ENAB-D2 when the data enable signal ENAB, the horizontal synchronizing signal HSYNC and the vertical synchronizing signal VSYNC are not supplied from the image data supply source at all.

Figure 6:
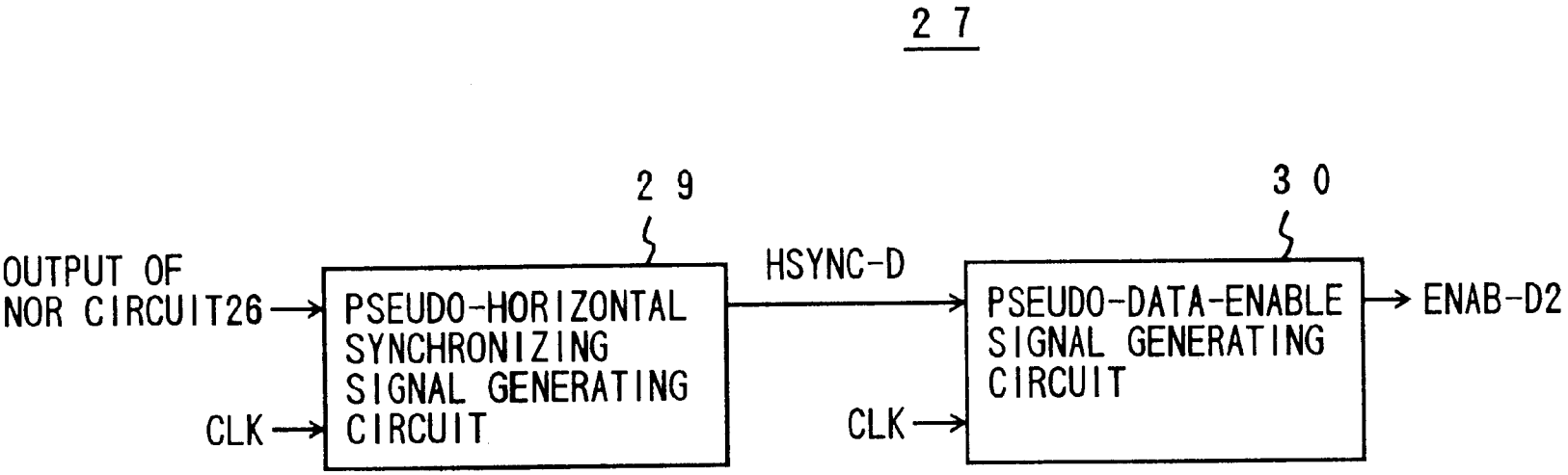
FIG. 6 is a block diagram of a protection circuit shown in FIG. 6.

FIG. 6 is a block diagram of the protection circuit 27, which is made up of a pseudo-horizontal-synchronizing signal generating circuit 29 and a pseudo-data-enable signal generating circuit 30. When the output signal of the NOR circuit 26 is high, the circuit 29 generates a pseudo-horizontal-synchronizing signal HSYNC-D. The circuit 30 generates the pseudo-data-enable signal ENAB-D2 when the circuit 29 outputs the pseudo-horizontal-synchronizing signal HSYNC-D.

Turning now to FIG. 5, the timing generating circuit 32 generates timing signals supplied to the data driver 11 and the gate driver 12 shown in FIG. 1. As shown in FIG. 5, the timing generating circuit 32 is supplied with the image data DATA and the clock CLK supplied from the image data supply source, and the output signals of the AND circuit 21, the pseudo-data-enable signal generating circuit 25, the D-type flip-flop 20, the AND circuit 24 and the protection circuit 27.

More particularly, the timing generating circuit 32 supplies the data driver 11 with the data driver clock D-CLK, the data driver start pulse D-SP, the latch pulse LP and the image data. Further, the timing generating circuit 32 supplies the gate driver 12 with the gate driver clock G-CLK and the gate driver start pulse G-SP.

Figure 7:
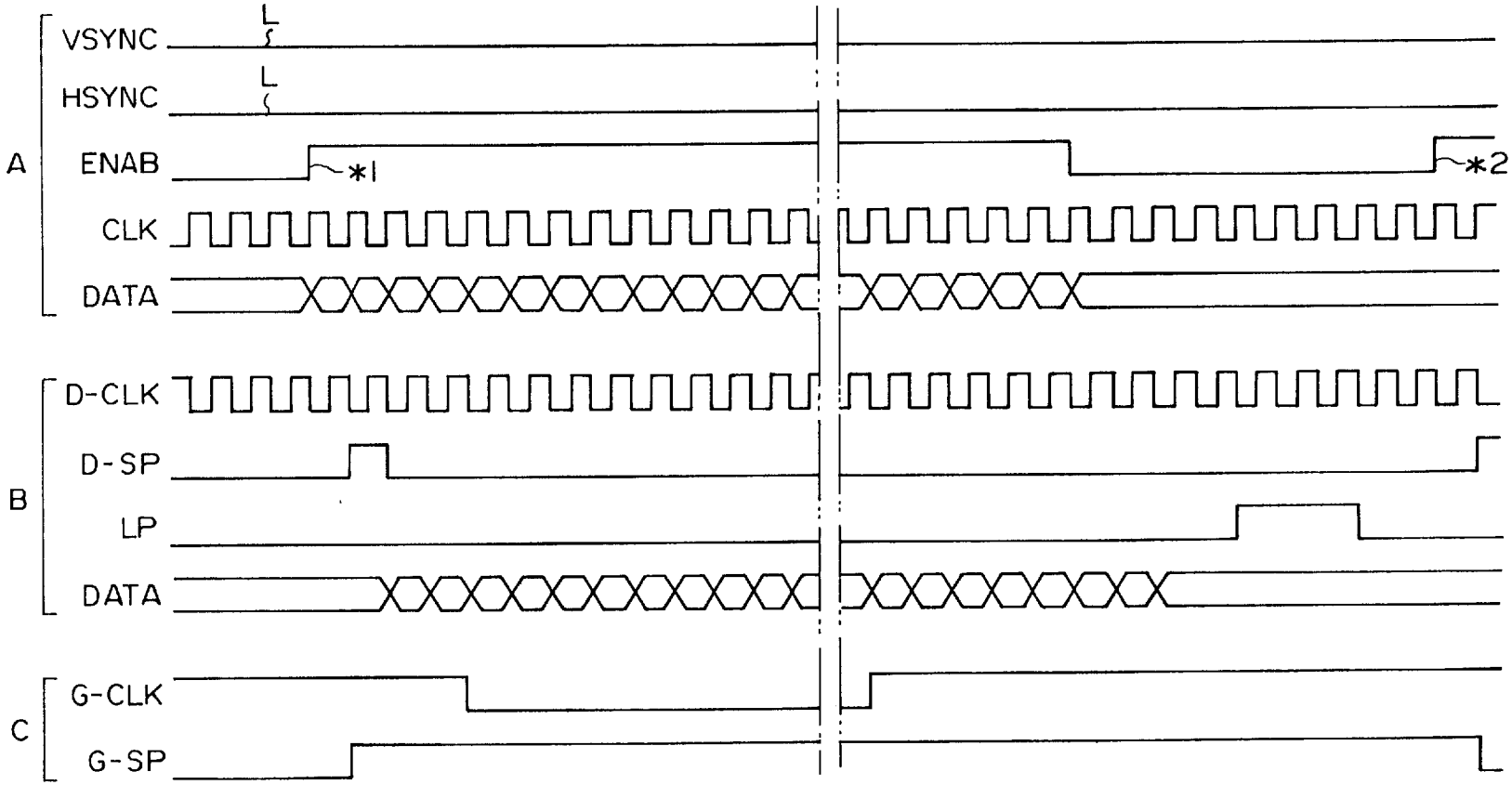
FIG. 7 is a timing chart of an operation of a timing generating circuit shown in FIG. 5.

FIG. 7 is a timing chart of an operation of the timing generating circuit 32 in the first display timing control mode when the output signal DET1 of the D-type flip-flop 20 is switched to the high level. More particularly, part (A) of FIG. 7 shows the vertical synchronizing signal VSYNC, the horizontal synchronizing signal HSYNC, the data enable signal ENAB, the clock CLK and the image data DATA. Part (B) of FIG. 7 shows the data driver clock D-CLK, the data driver start pulse D-SP, the latch pulse LP and the image data DATA, which are supplied to the data driver 11. Part (C) of FIG. 7 shows the gate driver clock G-CLK and the gate driver start pulse G-SP, which are supplied to the gate driver 12.

Figure 2:
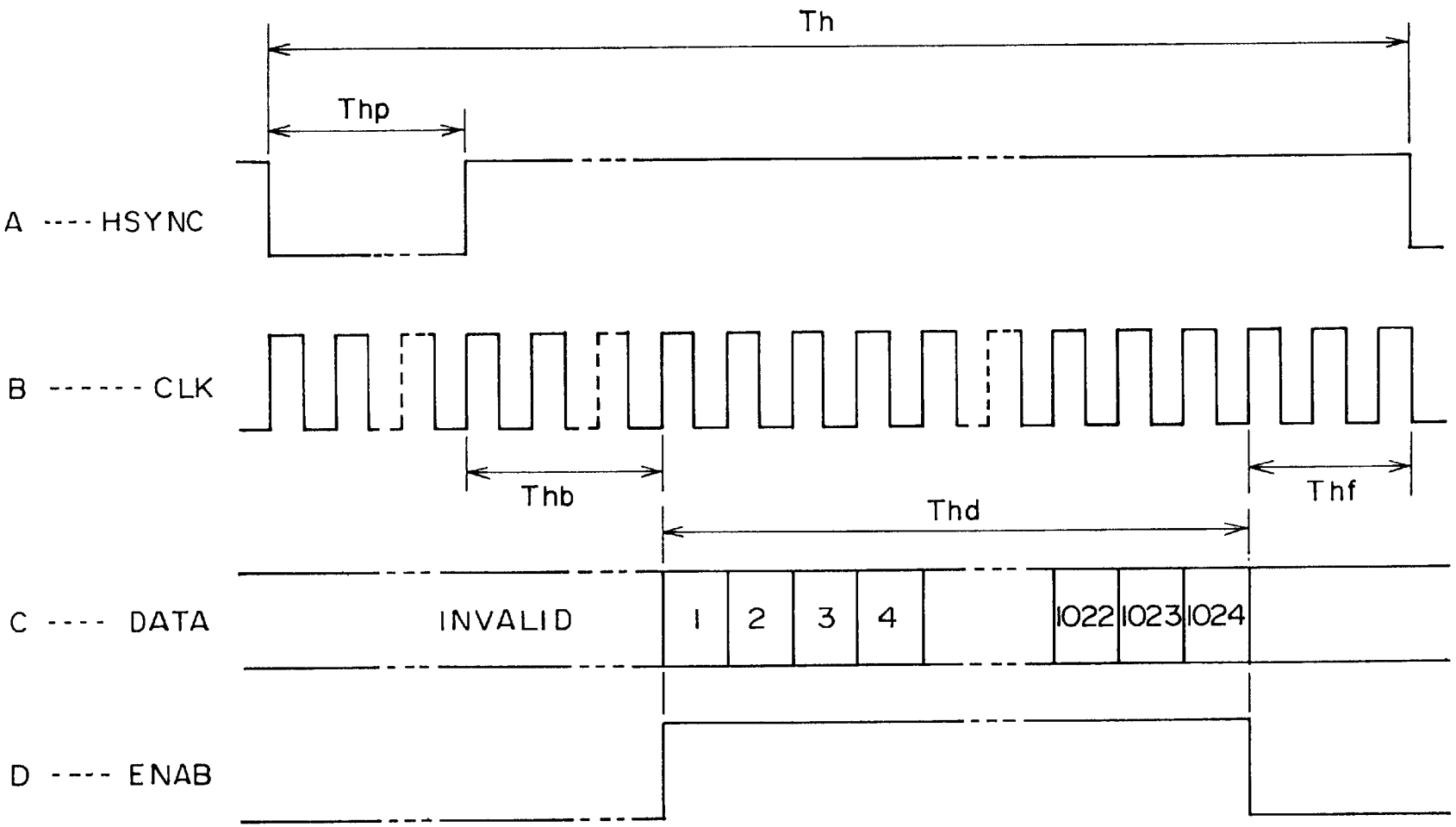
FIG. 2 PRIOR ART
FIG. 2 is a timing chart showing a drive timing in the horizontal direction of the conventional liquid-crystal display device shown in FIG. 1.
Figure 3:
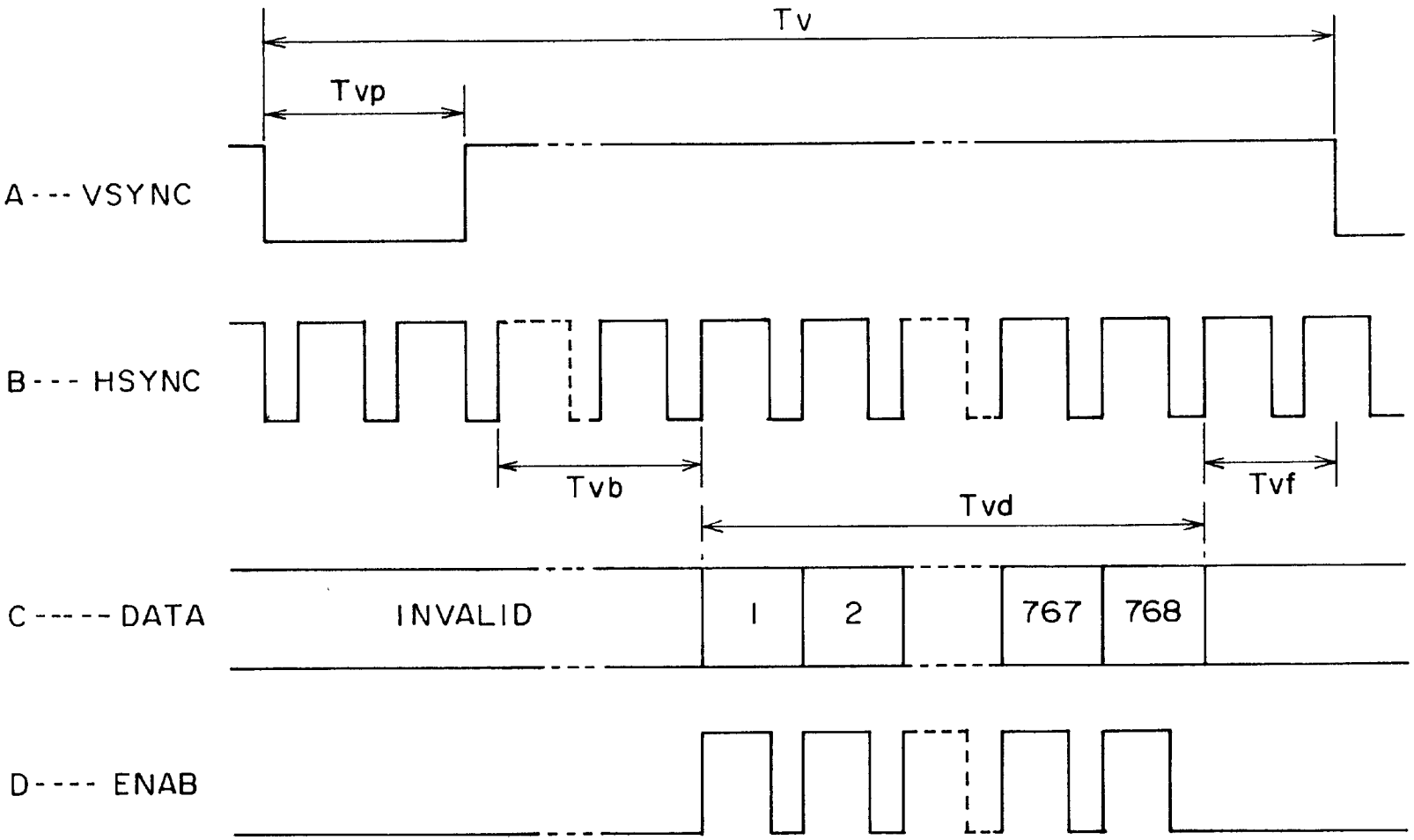
FIG. 3 PRIOR ART
FIG. 3 is a timing chart of a driving timing in the vertical direction of the conventional liquid-crystal display device shown in FIG. 1.
Figure 4:
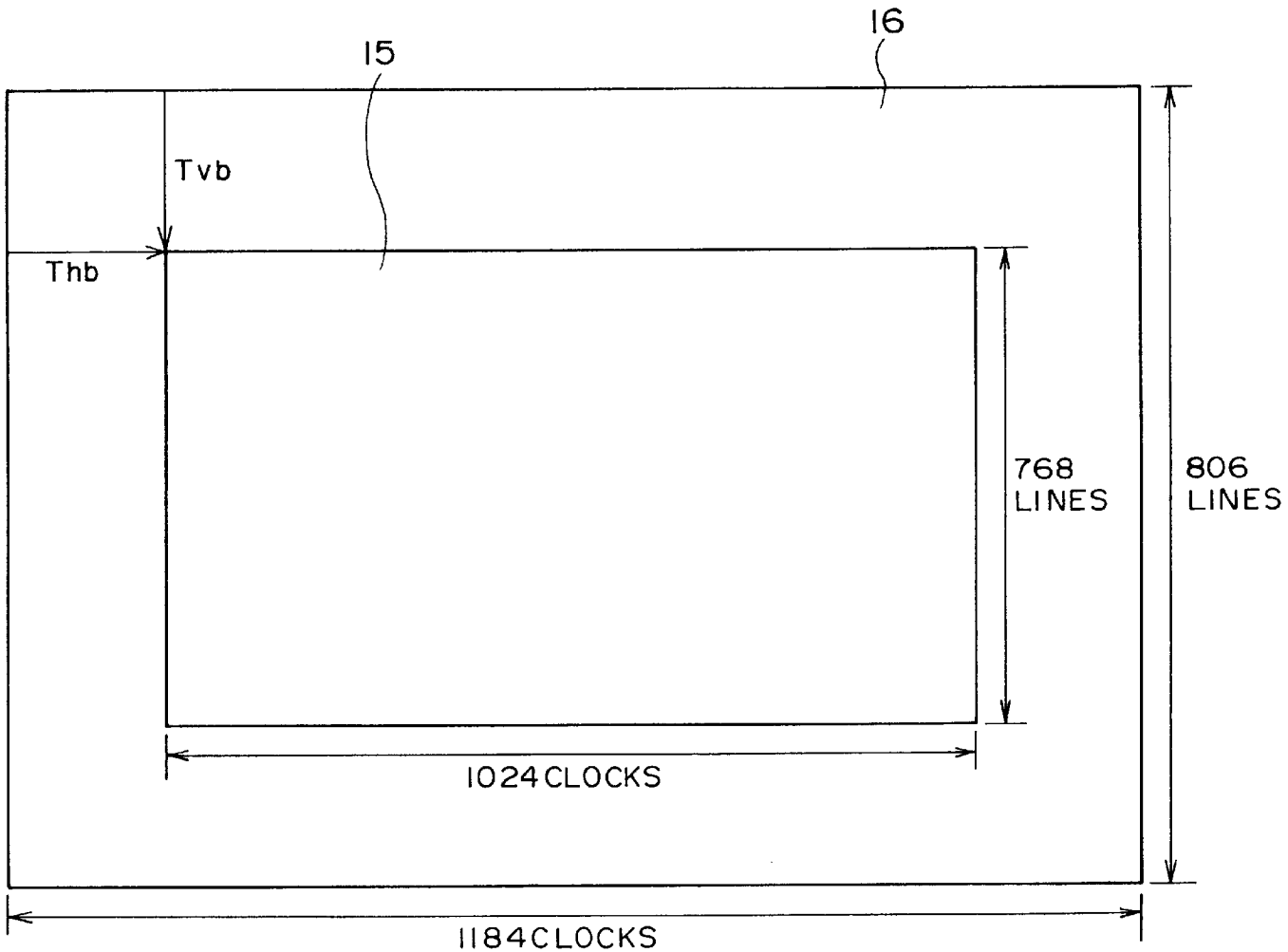
FIG. 4 PRIOR ART
FIG. 4 is a diagram showing a relationship between a data display area and a blank area handled during one vertical cycle period in the conventional liquid-crystal display device shown in FIG. 1.

As shown in FIG. 7, when the output signal DET1 of the D-type flip-flop 20 is switched to the high level, that is, when the data enable signal ENAB is supplied from the image data supply source, the timing generating circuit 32 controls the display timing based on the data enable signal ENAB supplied from the AND circuit 21 nevertheless the synchronizing signals VSYNC and HSYNC are maintained at the low level. The above timing control is quite different from the conventional timing control shown in FIG. 2.

More particularly, the image data DATA is supplied while the data enable signal ENAB is maintained at the high level. In FIG. 7, a rising edge *1 of the data enable signal ENAB corresponds to the first line of the display panel 10. While the image data DATA equal to one line is being supplied from the image data supply source, the data enable signal ENAB is maintained at the high level.

In response to the rising edge *1 of the data enable signal, the data driver start pulse D-SP is generated by the timing generating circuit 32 and is then output to the data driver 11. Further, in response to the rising edge *1 of the data enable signal ENAB, the gate driver start pulse G-SP is generated by the timing generating circuit 32 and is output to the gate driver 12. The gate driver start pulse G-SP is maintained at the high level during the first line. Thus, the gate driver start pulse D-SP is switched to the low level in response to the rising edge *2 of the data enable signal ENAB indicating the second line.

Further, the latch pulse LP and the gate driver clock G-CLK are generated by the timing generating circuit 32 by referring to the data enable signal ENAB as will be described in detail later. Furthermore, the data driver clock D-CLK is generated from the clock CLK by the timing generating circuit 32, as will be described in detail later.

As described above, by detecting only the data enable signal ENAB, it is possible to control the display timing so that the image data DATA can be displayed on the liquid-crystal display panel 10 from the first pixel which is first scanned. The above control corresponds to the first display timing control mode.

Figure 8:
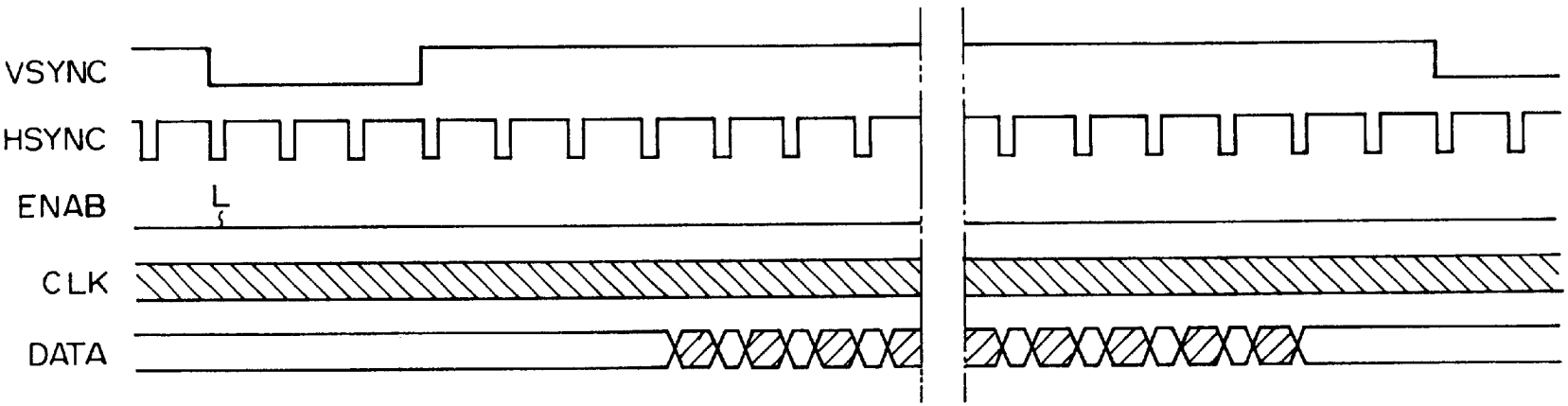
FIG. 8 is a timing chart of another operation of the timing generating circuit shown in FIG. 5.
Figure 9:
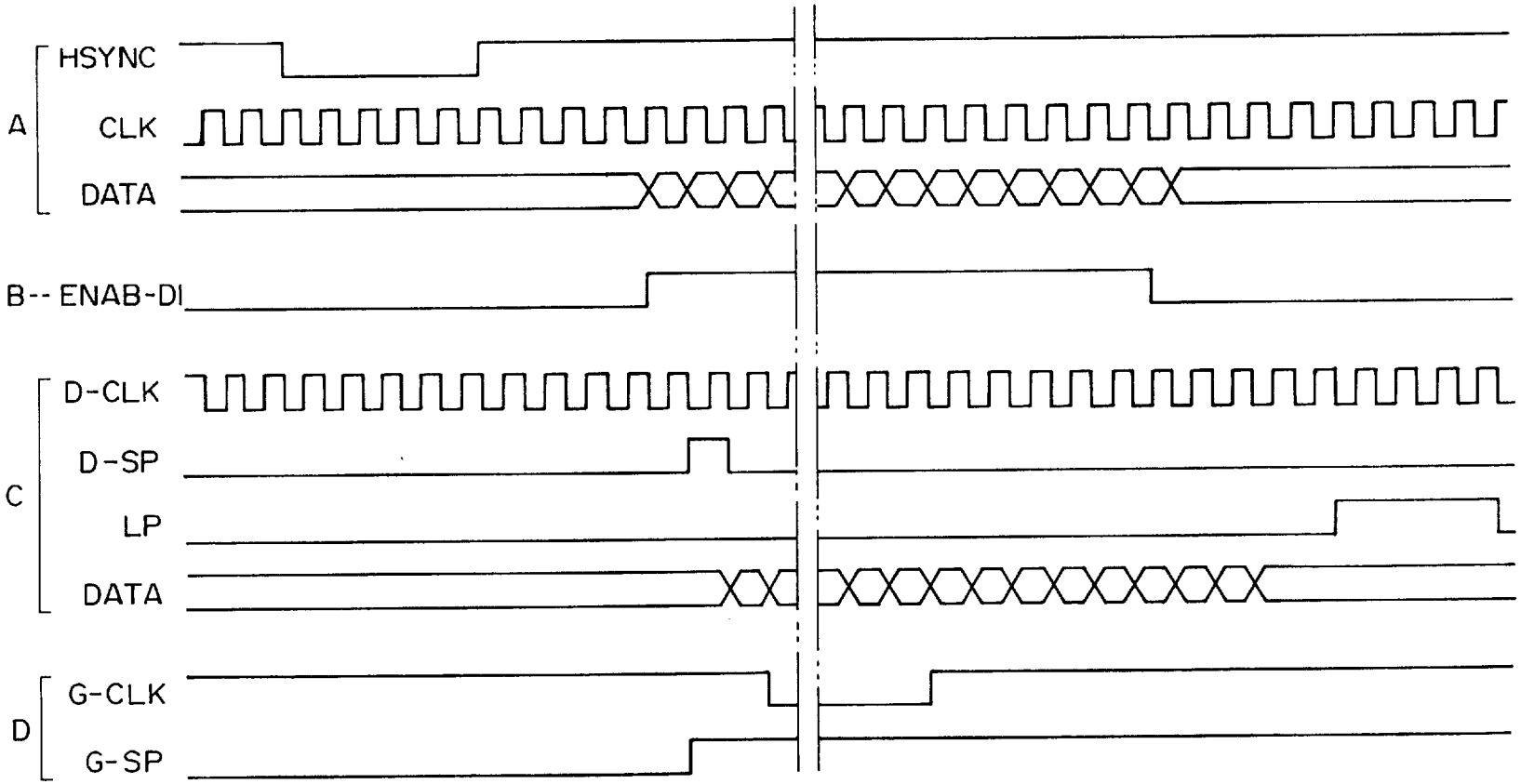
FIG. 9 is a timing chart of yet another operation of the timing generating circuit shown in FIG. 5.

FIGS. 8 and 9 are timing charts of an operation of the timing generating circuit 32 executed when the output signal DET2 of the AND circuit 24 is switched to the high level while the output signal DET1 of the D-type flip-flop 20 is maintained at the low level. In other words, the operation shown in FIGS. 8 and 9 is carried out in the second display timing control mode.

FIG. 8 shows the vertical synchronizing signal VSYNC, the horizontal synchronizing signal HSYNC, the data enable signal ENAB, the clock CLK and the image data DATA. Part (A) of FIG. 9 shows the horizontal synchronizing signal HSYNC, the clock CLK and the image data DATA. Part (B) of FIG. 9 shows the pseudo-data-enable signal ENAB-D1 generated by the pseudo-data-enable signal generating circuit 25. Part (C) of FIG. 9 shows the data driver clock D-CLK, the data driver start pulse D-SP, the latch pulse LP and the image data DATA. Part (D) of FIG. 9 shows the gate driver clock CLK and the gate driver start pulse G-SP.

As described above, when the output signal DET1 of the D-type flip-flop 20 is maintained at the low level and the output signal DET2 of the AND circuit 24 is switched to the high level, that is, when the data enable signal ENAB is not supplied from the image data supply source and the horizontal synchronizing signal HSYNC and the vertical synchronizing signal VSYNC are supplied, the timing generating circuit 32 generates the data driver clock signal D-CLK, the data driver start pulse D-SP, the latch pulse LP, the image data DATA, and the gate driver clock G-CLK, and the gate driver start pulse G-SP, so that the display timing of the image data DATA on the liquid-crystal display panel 10 can be controlled based on the pseudo-data-enable signal ENAB-D1.

If a fault occurs in, for example, the image data supply source and the data enable signal ENAB is not supplied therefrom while the image data DATA is duly supplied, the image data DATA cannot be displayed in the first display timing control mode. In such a case, the pseudo-data-enable signal ENAB-D1 is generated at the predetermined timing after the output signal DET2 of the AND circuit 24 is switched to the high level. Thus, the pseudo-data-enable signal ENAB-D1 may not be synchronized with the image data DATA, and the image data displayed on the liquid-crystal display panel 10 may be offset. However, the second display timing control mode can function as a backup mode which is to be activated when a supply of the data enable signal ENAB is interrupted due to a fault.

If the pseudo-data-enable signal ENAB-D1 is designed to be synchronized with the image data DATA by determining the back porches Thb and Tvb and the front porches Thf and Tvf, the second display timing control mode can meet the specific display timing specification as in the prior art.

Also, the second display timing control mode can be applied to a timing specification in which the horizontal synchronizing signal HSYNC and the vertical synchronizing signal VSYNC are supplied but the data enable signal ENAB is not supplied.

Figure 10:
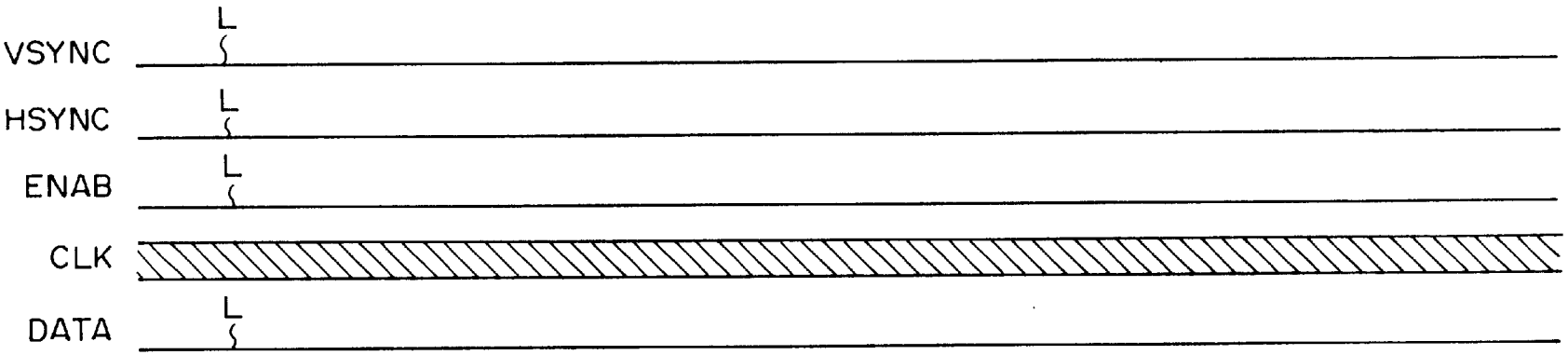
FIG. 10 is a timing chart of a further operation of the timing generating circuit shown in FIG. 5.
Figure 11:
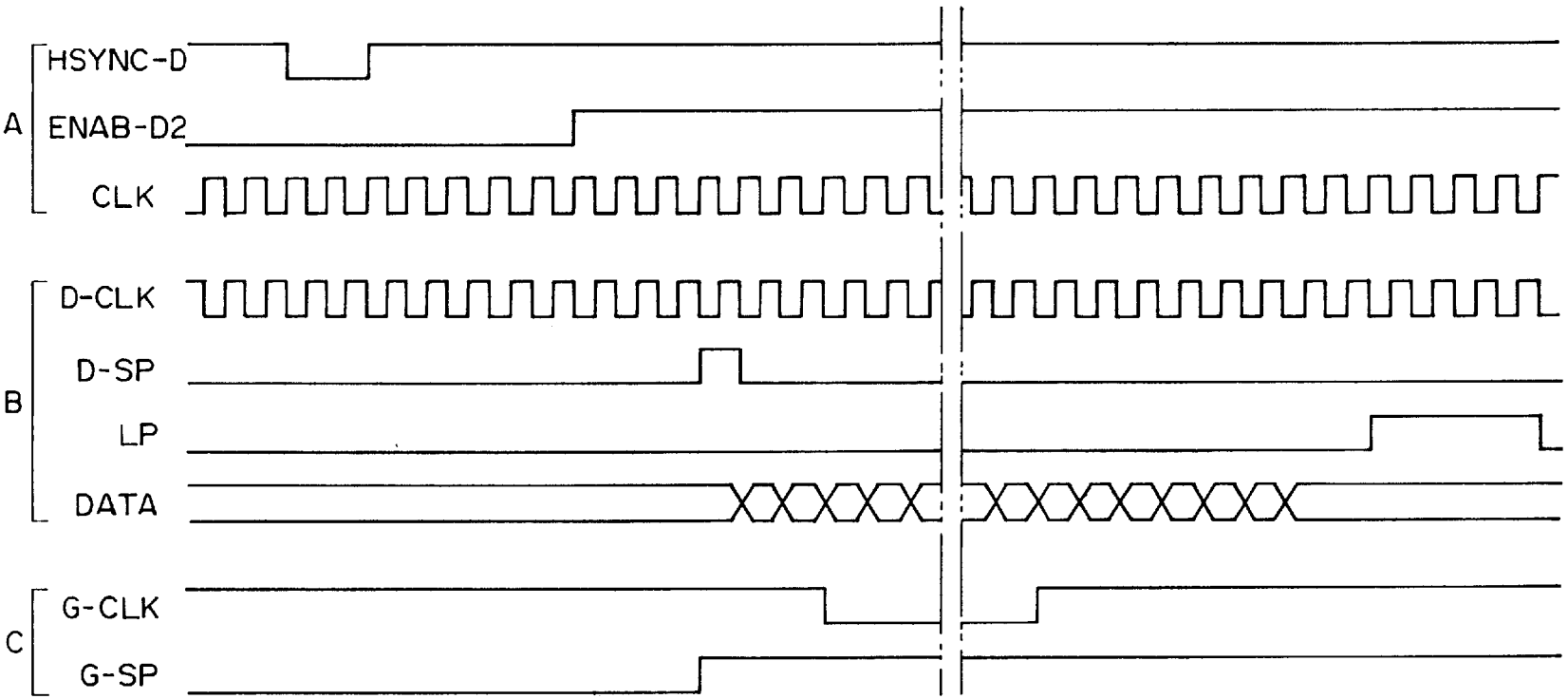
FIG. 11 is a timing chart of a still further operation of the timing generating circuit shown in FIG. 5.

FIGS. 10 and 11 are timing charts of an operation of the timing generating circuit 32 executed when the output signals DET1 and DET2 of the D-type flip-flop 20 and the AND circuit 24 are at the low level. In other words, the operation shown in FIGS. 10 and 11 is carried out in the third display timing control mode.

FIG. 10 shows the vertical synchronizing signal VSYNC, the horizontal synchronizing signal HSYNC, the data enable signal ENAB, the clock CLK and the image data DATA. Part (A) of FIG. 11 shows the pseudo-horizontal-synchronizing signal HSYNC-D generated by the circuit 29 shown in FIG. 6, the pseudo-data-enable signal ENAB-D2 generated by the circuit 30 shown in FIG. 6, and the clock CLK supplied from the image data supply source. Part (B) of FIG. 11 shows the data driver clock D-CLK, the data driver start pulse D-SP, the latch pulse LP and the image data DATA. Part (C) of FIG. 11 shows the gate driver clock G-CLK and the gate driver start pulse G-SP.

As described above, when the output signal DET1 of the D-type flip-flop 20 is maintained at the low level and the output signal DET2 of the AND circuit 24 is also at the low level, that is, when the data enable signal ENAB, the horizontal synchronizing signal HSYNC and the vertical synchronizing signal VSYNC are not supplied from the image data supply source, the timing generating circuit 32 generates the data driver clock signal D-CLK, the data driver start pulse D-SP, the latch pulse LP, the image data DATA, and the gate driver clock G-CLK, and the gate driver start pulse G-SP, so that the display timing of the image data DATA on the liquid-crystal display panel 10 can be controlled based on the pseudo-data-enable signal ENAB-D2. The above image data DATA is not supplied from the image data supply source but is generated by the timing generating circuit 32, as will be described in detail later.

Figure 12:
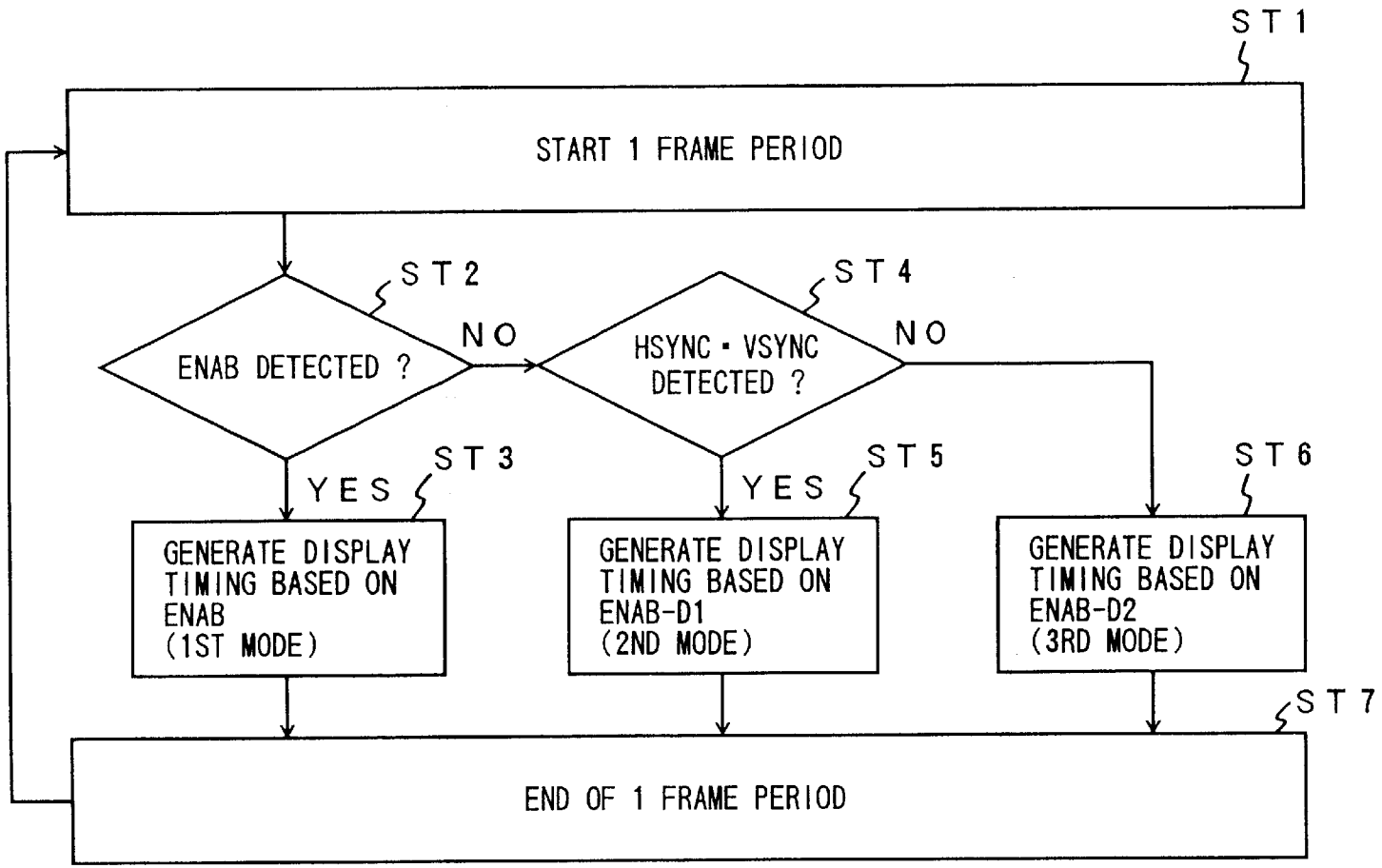
FIG. 12 is a flowchart of a sequence of the display timing control implemented by the timing generating circuit shown in FIG. 5.
Figure 13:
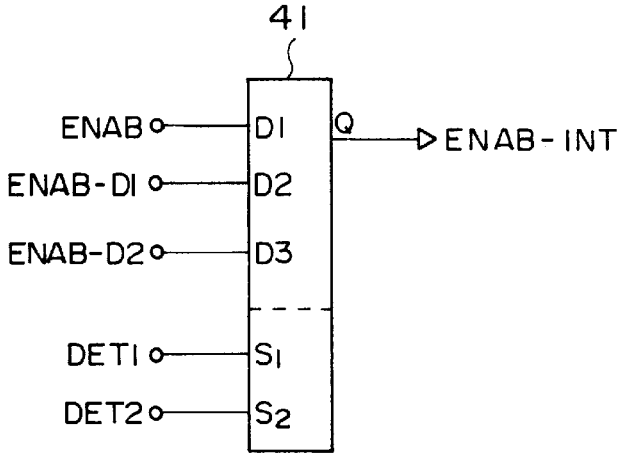
FIG. 13 is a block diagram of a part of the timing generating circuit shown in FIG. 5.

FIG. 12 is a flowchart of the sequence of the timing control implemented by the timing controller shown in FIG. 5. The sequence shown in FIG. 12 is executed every frame period. At step ST1, the timing generating circuit 32 shown in FIG. 5 detects the beginning of one frame, as will be described later.

At step ST2, the timing generating circuit 32 determines whether the data enable signal ENAB is detected by referring to the output signal of the AND circuit 21. If the answer of step ST2 is YES, the display timing control based on the data enable signal ENAB is carried out in the first display timing control mode at step ST3 as has been described previously. When the end of the present frame is detected at step ST7, the sequence returns to step ST1.

When the answer of step ST2 is NO, the timing generating circuit 32 determines whether the horizontal synchronizing signal HSYNC and the vertical synchronizing signal VSYNC are detected. When the answer of step ST4 is YES, the display timing control based on the pseudo-data-enable signal ENAB-D1 is carried out in the second display timing control mode. The timing controller 32 controls the data driver 11 and the gate driver 12 so that the display timing of the image data DATA on the display panel 10 can be carried out based on the pseudo-data-enable signal ENAB-D1. Then, the sequence returns to step ST1 after the end of the present frame is detected.

When the answer of step ST4 is NO, the display timing control based on the pseudo-data-enable signal ENAB-D2 is carried out in the third display timing control mode. The timing controller 32 controls the data driver 11 and the gate driver 12 so that the display timing of the image data DATA on the display panel 10 can be carried out based on the pseudo-data-enable signal ENAB-D2. Then, the sequence returns to step ST1 after the end of the present frame is detected.

A description will be given of an internal structure of the timing generating circuit 32 shown in FIG. 5.

FIGS. 13, 14 and 15A through 15F are block diagrams of internal components of the timing generating circuit 32. First, referring to FIG. 13, the timing generating circuit 32 includes a 3-to-1 selector 41, which selects one of three inputs ENAB, ENAB-D1 and ENAB-D2 in accordance with the signals DET1 and DET2 shown in FIG. 5. Table 1 is the truth table of the selector 41.

TABLE 1

| S1 | S2 | D1 | D2 | D3 | Q |
|---|---|---|---|---|---|
| H | L | H | — | — | H |
| H | L | L | — | — | L |
| L | H | — | H | — | H |
| L | H | — | L | — | L |
| L | L | — | — | H | H |
| L | L | — | — | L | L |

Figure 14:
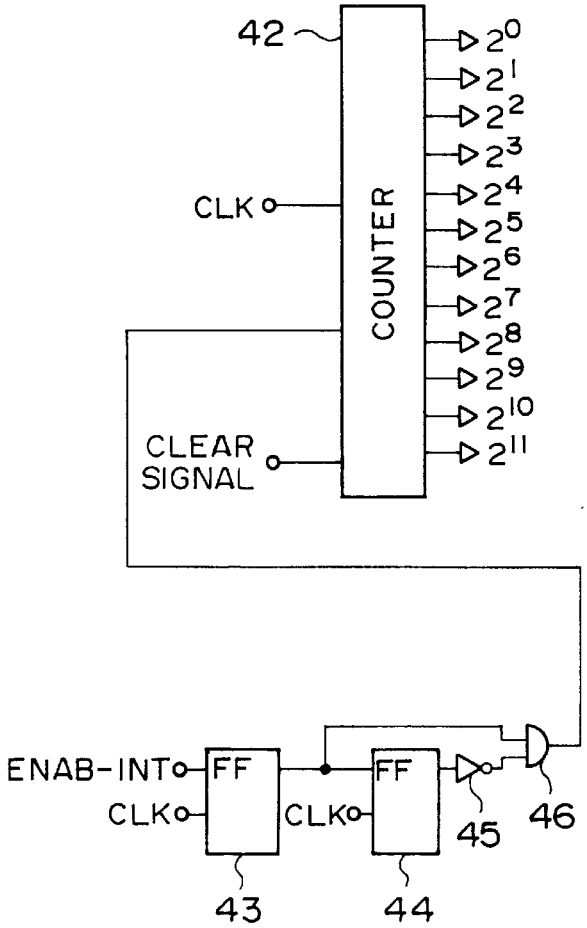
FIG. 14 is a block diagram of another part of the timing generating circuit shown in FIG. 5.

The selected data enable signal is output, as an internal data enable signal ENAB-INT, to the part shown in FIG. 14.

The part shown in FIG. 14 includes two flip-flops 43 and 44, an inverter 45, an OR circuit 46 and a 12-bit binary counter 42. The selected data enable signal ENAB-INT is applied to the flip-flop 43. The flip-flops 43 and 44, the inverter 45 and the OR circuit 46 detect the beginning (leading edge) of the internal data enable signal ENAB-INT in which the internal data enable signal ENAB-INT switches from the low level to the high level. The output signal of the OR circuit 46 is applied, as a reset signal, to the binary counter 42. In response to the reset signal, the binary counter 42 starts to count the clock CLK. The count value expressed by 12 bits $2^0$–$2^{11}$ are used to generate the gate driver clock G-CLK, the latch pulse LP, the data driver start pulse D-SP and the gate driver start pulse G-SP, as will be described below. The count value is cleared by a clear signal externally supplied.

Figure 15A:
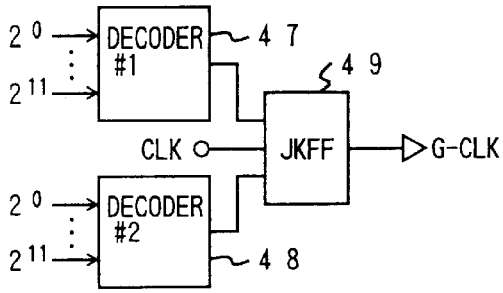
FIGS. 15A, 15B, 15C, 15D, 15E and 15F are block diagrams of further parts of the timing generating circuit shown in FIG. 5.

FIG. 15A shows a circuit part of the timing generating circuit 32 which generates the gate driver clock pulse G-CLK. The circuit part shown in FIG. 15A includes a decoder (#1) 47, a decoder (#2) 48 and a JK-type flip-flop 49. The decoders 47 and 48 separately decode the 12 bits of the count value and apply respective output signals to the JK-type flip-flop 49 when respective predetermined count values are decoded. Then, the JK-type flip-flop 49 supplied with the clock CLK outputs the gate driver clock G-CLK.

Figure 15B:
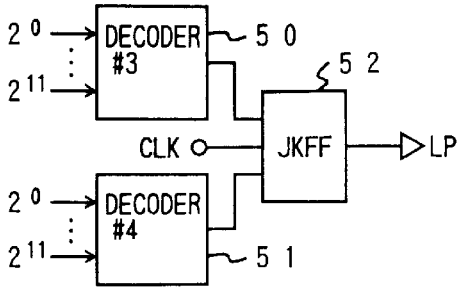

FIG. 15B shows a circuit part of the timing generating circuit 32 which generates the latch pulse LP. The circuit part shown in FIG. 15B includes a decoder (#3) 50, a decoder (#4) 51 and a JK-type flip-flop 52. The decoders 50 and 51 separately decode the 12 bits of the count value and apply respective output signals to the JK-type flip-flop 52 when respective predetermined count values are decoded. Then, the JK-type flip-flop 52 supplied with the clock CLK outputs the latch pulse LP.

Figure 15C:
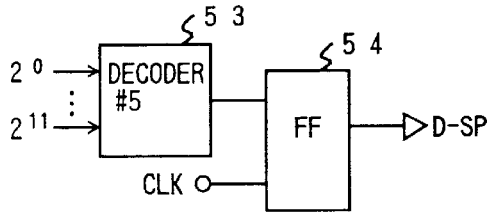

FIG. 15C shows a circuit part of the timing generating circuit 32 which generates the data driver start pulse D-SP. The circuit part shown in FIG. 15C includes a decoder (#5) 53 and a flip-flop 54. The decoder 53 applies an output signal to the flip-flop 54 when a predetermined count value is decoded. Then, the flip-flop 54 supplied with the clock CLK outputs the data driver start pulse D-SP.

Figure 15D:
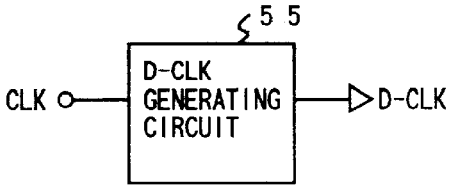

FIG. 15D shows a circuit part of the timing generating circuit 32 which includes a data driver clock generating circuit 55 for generating the data clock D-CLK from the clock CLK.

Figure 15E:
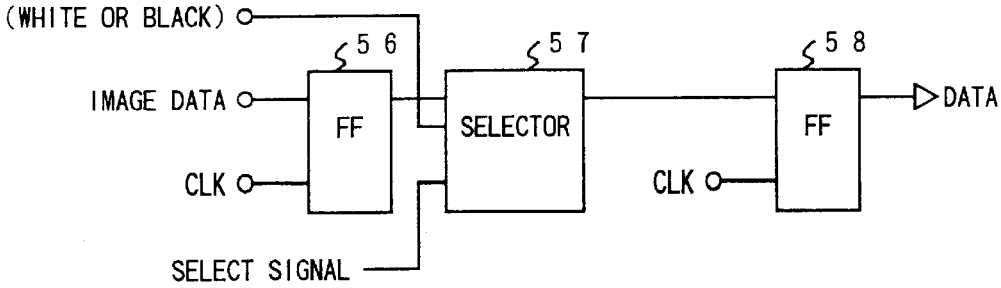

FIG. 15E shows a circuit part of the timing generating circuit 32 which outputs image data DATA. The circuit part shown in FIG. 15E is made up of a flip-flop 56, a selector 57 and a flip-flop 58. The flip-flop 56 latches the image data supplied from the external image data supply source. The latched image data is applied to the selector 57, which is also supplied with out-of-display-area display color data (white or black). This color data is used in the third display timing control mode in which the external image data DATA is not supplied. The selector 57 selects the external image data DATA or the color data in accordance with a data select signal, which corresponds to the output signal of the NOR circuit 26 shown in FIG. 5. The selected image data is latched in the flip-flop 58 and is then output to the liquid-crystal display panel 10.

Figure 15F:
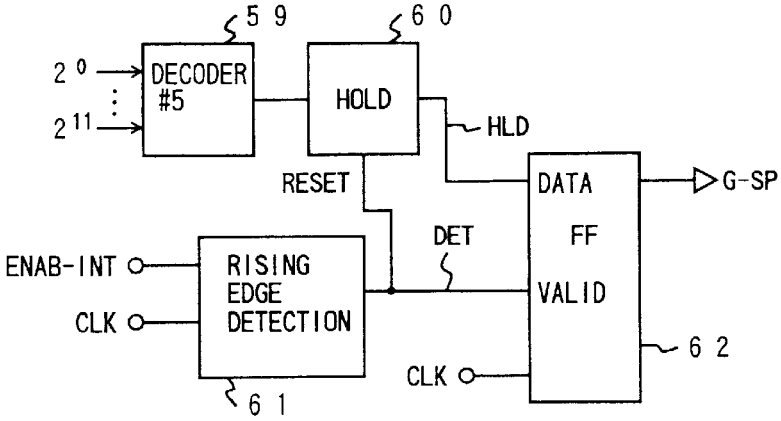
Figure 16:
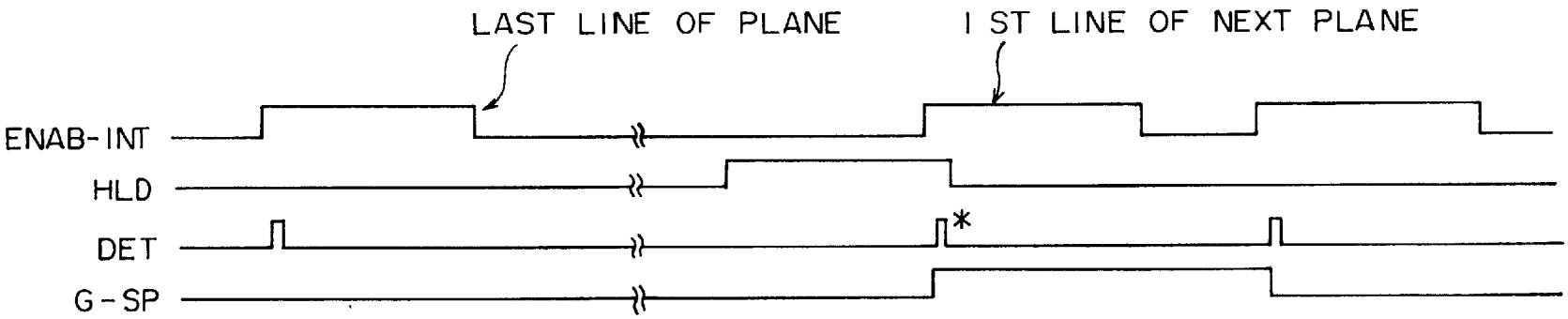
FIG. 16 is a timing chart of an operation of the circuit part shown in FIG. 15F.

FIG. 15F shows a circuit part of the timing generating circuit 32 which outputs the gate driver start pulse G-SP. FIG. 16 is a timing chart of an operation of the circuit part shown in FIG. 15F. The circuit part shown in FIG. 15F detects the beginning of each frame and generates the gate driver start pulse G-SP from the internal data enable signal ENAB-INT during the period equal to the first line.

The circuit part shown in FIG. 15F is made up of a decoder (#6) 59, a hold circuit 60, a leading edge detection circuit 61, and a flip-flop 62 having a data valid terminal. The leading edge detection circuit 61 is made up of the flip-flops 43 and 44, the inverter 45 and the OR circuit 46 shown in FIG. 14. When the internal data enable signal ENAB-INT is maintained at the low level during a given constant period, the decoder 59 outputs a high pulse, which is held in the hold circuit 60. The high pulse held in the hold circuit 60 is applied, as HLD, to a data terminal of the flip-flop 62. The circuit 61 outputs a pulse each time detecting the leading edge of the internal data enable signal ENAB-INT. The pulse output by the circuit 61 is applied, as a reset signal, to the hold circuit 60, and is applied, as a data valid signal, to the data valid terminal of the flip flop 62.

While one line is being scanned, the internal data enable signal ENAB-INT switches from the low level to the high level before the given constant time elapses. During the blanking period between adjacent lines, the internal data enable signal ENAB-INT is maintained at the low level. At this time, the decoder 59 outputs the pulse, which is held in the hold circuit 60. After the given constant period, the internal data enable signal ENAB-INT switches to the high level. This indicates the beginning of the next line. The pulse * shown in FIG. 16 is applied to the data valid terminal of the flip-flop 62, which receives the high-level signal via the data terminal. Hence, the output signal of the flip-flop 62 is switched to the high level and is maintained at the high level until the next leading edge of the internal data enable signal ENAB-INT is detected.

According to the above-mentioned embodiment of the present invention, the display timing of the image data DATA on the liquid-crystal display panel 10 can be controlled based on the data enable signal ENAB externally supplied from the image data supply source. The data enable signal ENAB is activated at the beginning of the image data DATA. Hence, the image data can duly be displayed on the liquid-crystal display panel 10 starting from the first pixel on the first line. That is, the display timing does not depend on the aforementioned back porches and front porches. Hence, the timing controller of the present embodiment can be applied to arbitrary display timing of electronic devices to which the liquid-crystal display device is mounted. Hence, the development of electronic devices to which the liquid-crystal display device is mounted can be facilitated. It is not necessary to design various timing controllers so as to meet the different timing control specifications.

Also, in the second display timing control mode, the pseudo-data-enable signal ENAB-D1 is generated from the horizontal synchronizing signal HSYNC and the vertical synchronizing signal VSYNC. That is, the second display timing control mode realizes the specific display timing that depends on the back porches and front porches in the horizontal and vertical directions. This satisfies a user's demand to have the conventional display timing control. Also, the second display timing control mode can function as a backup mode of the first display timing control mode when the data enable signal ENAB is lost due to a fault.

Further, the liquid-crystal display panel 10 can be ac-driven even if the data enable signal ENAB, the horizontal synchronizing signal HSYNC and the vertical synchronizing signal VSYNC are not supplied from the image data supply source at all. Hence, it is possible to prevent a dc voltage from being continuously be applied to the pixels of the liquid-crystal display panel 10 and to prevent the panel 10 from being thus degraded.

Figure 17:
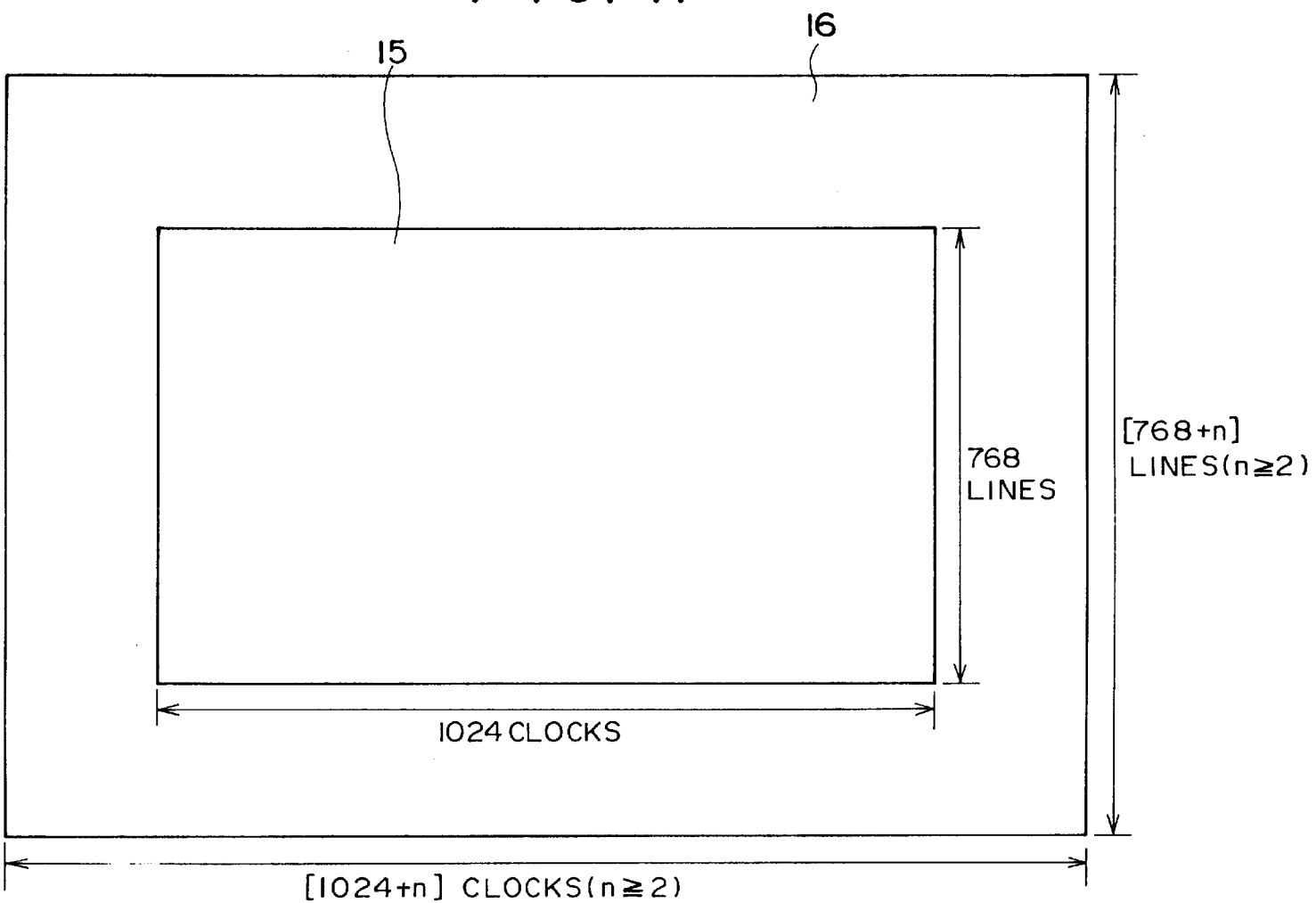
FIG. 17 is a diagram showing a relationship between a data display area and a blank area during one vertical cycle period according to the embodiment of the present invention.

As has been described previously, the timing generating circuit 32 defines the display timing based on the data enable signal ENAB, the pseudo-data-enable signal ENAB-D1 or the pseudo-data-enable signal ENAB-D2. Hence, as shown in FIG. 17, the blanking areas in the horizontal direction each equal to n clocks ($n \geqq 2$), for example, two lines can be provided on both sides of the data display area 15. Similarly, the blanking areas in the vertical direction each equal to n clocks, for example, two clocks can be provided on both sides of the data display area 15. Hence, the liquid-crystal display panel can be driven during the reduced blanking periods in the horizontal and vertical directions.

The present invention is not limited to the specifically disclosed embodiments, and variations and modifications may be made without departing from the scope of the present invention.

What is claimed is:

1. A timing controller for a liquid-crystal display panel comprising:

a data enable signal detection circuit which detects a data enable signal applied to the timing controller;

a timing generating circuit which controls a display timing of image data to be displayed on the liquid-crystal display panel on the basis of the data enable signal detected by the data enable signal detection circuit;

a synchronizing signal detection circuit which detects vertical and horizontal synchronizing signals; and a pseudo-data-enable signal generating circuit which generates a pseudo-data-enable signal when the synchronization signal detection circuit detects the vertical and horizontal synchronizing signals while the data enable signal detection circuit, does not detect the data enable signal;

wherein the timing generating circuit controls the display timing of image data on the basis of the pseudo-data-enable signal.

2. A timing controller for a liquid-crystal display panel comprising:

a data enable signal detection circuit which detects a data enable signal applied to the timing controller;

a timing generating circuit which controls a display timing of image data to be displayed on the liquid-crystal display panel on the basis of the data enable signal detected by the data enable signal detection circuit;

a synchronizing signal detection circuit which detects vertical and horizontal synchronizing signals; and a protection circuit which generates a pseudo-data-enable signal when the data enable signal and the vertical and horizontal synchronizing signals are not detected;

wherein the timing generating circuit controls, the display timing of image data on the basis of the pseudo-data-enable signal.

3. A liquid-crystal display device comprising:

a liquid-crystal display panel having signal lines and scanning lines;

a data driver which drives the signal line;

a gate driver which drives the scanning lines; and a timing controller controlling a display timing of image data to be displayed on the liquid-crystal display panel, the timing controller comprising:

a data enable signal detection circuit which detects a data enable signal applied to the timing controller; and a timing generating circuit which controls the display timing on the basis of the data enable signal detected by the data enable signal detection circuit;

the liquid-crystal display device further comprising:

a synchronizing signal detection circuit which detects vertical and horizontal synchronizing signals; and a pseudo-data-enable signal generating circuit which generates a pseudo-data-enable signal when the synchronization signal detection circuit detects the vertical and horizontal synchronizing signals while the data enable signal detection circuit does not detect the data enable signal;

wherein the timing generating circuit controls the display timing of image data on the basis of the pseudo-data-enable signal.

4. A liquid-crystal display device comprising:

a liquid-crystal display panel having signal lines and scanning lines;

a data driver which drives the signal lines;

a gate driver which drives the scanning lines; and a timing controller controlling a display timing of image data to be displayed on the liquid-crystal display panel, the timing controller comprising:

a data enable signal detection circuit which detects a data enable signal applied to the timing controller; and a timing generating circuit which controls the display timing on the basis of the data enable signal detected by the data enable signal detection circuit;

the liquid-crystal display device further comprising:

a synchronizing signal detection circuit which detects vertical and horizontal synchronizing signals; and a protection circuit which generates a pseudo-data-enable signal when the data enable signal and the vertical and horizontal synchronizing signals are not detected;

wherein the timing generating circuit controls the display timing of image data on the basis of the pseudo-data-enable signal.

5. A liquid-crystal display device comprising:

a liquid-crystal display panel having signal lines and scanning lines;

a data driver which drives the signal line;

a gate driver which drives the scanning lines; and a timing controller controlling a display timing of image data to be displayed on the liquid-crystal display panel, the timing controller comprising:

a data enable signal detection circuit which detects a data enable signal applied to the timing controller; and a timing generating circuit which controls the display timing on the basis of the data enable signal detected by the data enable signal detection circuit the liquid-crystal display device further comprising:

a synchronizing signal detection circuit which detects vertical and horizontal synchronizing signals; and a pseudo-data-enable signal generating circuit which generates a first pseudo-data-enable signal when the synchronization signal detection circuit detects the vertical and horizontal synchronizing signals while the data enable signal detection circuit does not detect the data enable signal; and a protection circuit which generates a second pseudo-data-enable signal when the data enable signal and the vertical and horizontal synchronizing signals are not detected;

wherein the timing generating circuit controls the display timing of image data on the basis of any of the data enable signal, the first pseudo-data-enable signal and the second pseudo-data-enable signal.

* * * * *